US010744754B2

(12) United States Patent
Williams et al.

(10) Patent No.: US 10,744,754 B2
(45) Date of Patent: Aug. 18, 2020

(54) FOG DEVELOPMENT FOR DIGITAL OFFSET PRINTING APPLICATIONS

(71) Applicant: PALO ALTO RESEARCH CENTER INCORPORATED, Palo Alto, CA (US)

(72) Inventors: Antonio St. Clair Lloyd Williams, Mountain View, CA (US); David K. Biegelsen, Portola Valley, CA (US); David Mathew Johnson, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 204 days.

(21) Appl. No.: 16/032,591

(22) Filed: Jul. 11, 2018

(65) Prior Publication Data

US 2020/0016885 A1 Jan. 16, 2020

(51) Int. Cl.

| | |
|---|---|
| ***B41F 7/26*** | (2006.01) |
| ***G03G 15/10*** | (2006.01) |
| ***G03G 15/26*** | (2006.01) |
| ***B41C 1/10*** | (2006.01) |
| ***B41M 1/06*** | (2006.01) |

(52) U.S. Cl.

CPC ..... *B41F 7/26* (2013.01); *B41C 1/1041* (2013.01); *B41C 1/1058* (2013.01); *B41M 1/06* (2013.01); *G03G 15/101* (2013.01); *G03G 15/104* (2013.01); *G03G 15/266* (2013.01)

(58) Field of Classification Search

None

See application file for complete search history.

(56) References Cited

U.S. PATENT DOCUMENTS

| | | | |
|---|---|---|---|
| 2,551,582 A | 5/1951 | Carlson | |
| 8,958,723 B2 | 2/2015 | Liu | |
| 9,316,993 B2 * | 4/2016 | Veres | G03G 17/02 |

* cited by examiner

*Primary Examiner* — Joshua D Zimmerman

(74) *Attorney, Agent, or Firm* — Caesar Rivise, PC

(57) ABSTRACT

Ink-based digital printing systems useful for ink printing include a photoreceptor layer configured to receive a layer of liquid immersion fluid. The liquid immersion fluid includes dampening fluid, dispersed gas particles, and charge directors that impart charge to the solid particles. The photoreceptor surface is charged to a uniform potential, and selectively discharged using an ROS according to image data to form an electrostatic latent image. The charged liquid immersion fluid adheres to portions of the photoreceptor surface according to the electrostatic latent image to form a fountain solution image. The fluid portion of the fountain solution image can be partially transferred to an imaging member and/or transfer member to form a dampening fluid image, either or both of which may be electrically biased. The dampening fluid image is inked on the transfer member, and the resulting ink image transferred to a print substrate.

25 Claims, 6 Drawing Sheets

FOG DEVELOPMENT FOR DIGITAL OFFSET PRINTING APPLICATIONS

BACKGROUND OF THE INVENTION

The present disclosure is related to marking and printing systems, and more specifically to variable data lithography system using fog development of an electrographic image for creating a fountain solution image.

Offset lithography is a common method of printing today. For the purpose hereof, the terms "printing" and "marking" are interchangeable. In a typical lithographic process a printing plate, which may be a flat plate, the surface of a cylinder, belt, and the like, is formed to have "image regions" formed of hydrophobic and oleophilic material, and "non-image regions" formed of a hydrophilic material. The image regions are regions corresponding to the areas on the final print (i.e., the target substrate) that are occupied by a printing or a marking material such as ink, whereas the non-image regions are the regions corresponding to the areas on the final print that are not occupied by the marking material.

The Variable Data Lithography (also referred to as Digital Lithography or Digital Offset) printing process usually begins with a fountain solution used to dampen a silicone imaging plate on an imaging drum. The fountain solution forms a film on the silicone plate that is on the order of about one (1) micron thick. The drum rotates to an 'exposure' station where a high power laser imager is used to remove the fountain solution at the locations where the image pixels are to be formed. This forms a fountain solution based 'latent image'. The drum then further rotates to a 'development' station where lithographic-like ink is brought into contact with the fountain solution based 'latent image' and ink 'develops' onto the places where the laser has removed the fountain solution. The ink is usually hydrophobic for better adhesion on the plate and substrate. An ultra violet (UV) light may be applied so that photo-initiators in the ink may partially cure the ink to prepare it for high efficiency transfer to a print media such as paper. The drum then rotates to a transfer station where the ink is transferred to a printing medium such as paper. The silicone plate is compliant, so an offset blanket is not used to aid transfer. UV light may be applied to the paper with ink to fully cure the ink on the paper. The ink is on the order of one (1) micron pile height on the paper.

The formation of the image on the printing plate is usually done with imaging modules each using a linear output high power infrared (IR) laser to illuminate a digital light projector (DLP) multi-mirror array, also referred to as the "DMD" (Digital Micromirror Device). The mirror array is similar to what is commonly used in computer projectors and some televisions. The laser provides constant illumination to the mirror array. The mirror array deflects individual mirrors to form the pixels on the image plane to pixel-wise evaporate the fountain solution on the silicone plate to create a fountain solution image. If a pixel is not to be turned on, the mirrors for that pixel deflect such that the laser illumination for that pixel does not hit the silicone surface, but goes into a chilled light dump heat sink. A single laser and mirror array form an imaging module that provides imaging capability for approximately one (1) inch in the cross-process direction. Thus a single imaging module simultaneously images a one (1) inch by one (1) pixel line of the image for a given scan line. At the next scan line, the imaging module images the next one (1) inch by one (1) pixel line segment. By using several imaging modules, comprising several lasers and several mirror-arrays, butted together, imaging function for a very wide cross-process width is achieved.

Due to the need to evaporate the fountain solution, in the imaging module, power consumption of the laser accounts for the majority of total power consumption of the whole system. Such being the case, a variety of power and cost saving technologies for the imaging modules have been proposed. For example, the schemes to reduce the size of the image formed on the printing plate, changing the depth of the pixel, and substituting less powerful image creating source such as a conventional Raster Output Scanner (ROS). To evaporate a one (1) micron thick film of water, at process speed requirements of up to five meters per second (5 m/s), requires on the order of 100,000 times more power than a conventional xerographic ROS imager. In addition, cross-process width requirements are on the order of 36 inches, which makes the use of a scanning beam imager problematic. Thus a special imager design is required that reduces power consumption in a printing system. An overlooked area of power conservation is the use of non-laser imagers or alternative ways of creating the fountain solution image.

For the reasons stated above, and for other reasons stated below which will become apparent to those skilled in the art upon reading and understanding the present specification, there is a need in the art for increasing speed and lowering power consumption in variable data lithography system.

BRIEF SUMMARY OF THE INVENTION

According to aspects of the embodiments, systems, methods, and fountain solution in accordance with embodiments are provided for producing a fountain solution image without the requirement for a high power laser. Aspects of the embodiments invoke creating a fountain solution image by fog development of a charge image created electrographically that can be inked and transferred to a print substrate or in the alternative transferring the fountain solution image to a silicone surface such as the surface of a drum or belt for inking and transfer to a final substrate.

DETAILED DESCRIPTION OF THE INVENTION

Figure 1:
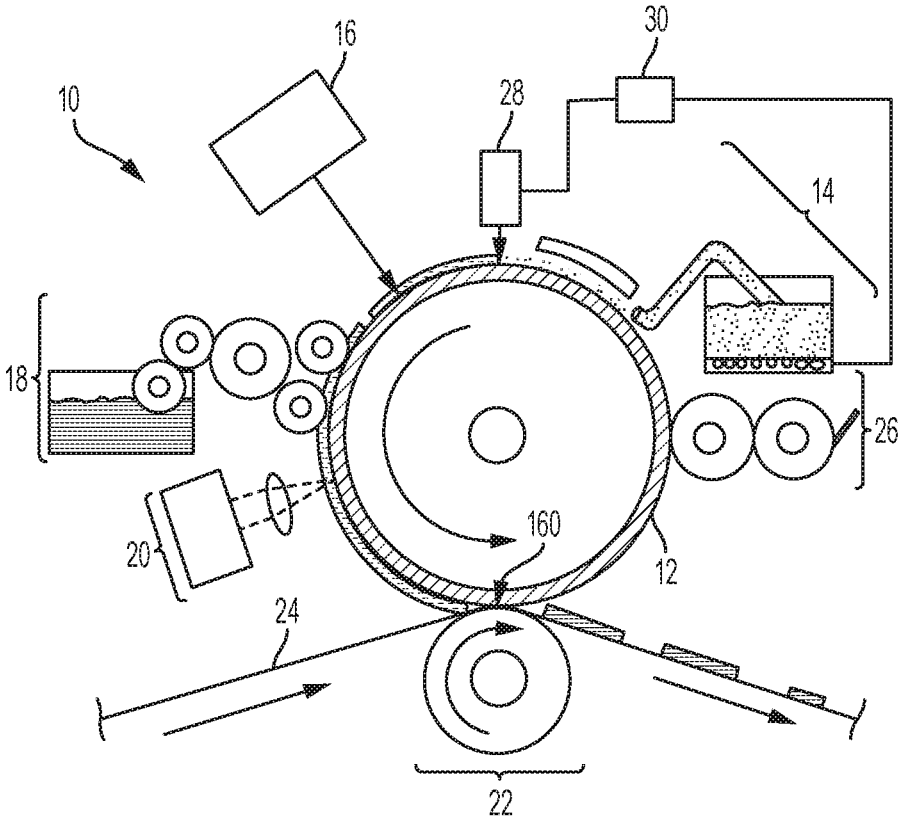
RELATED ART FIG. 1
FIG. 1 illustrates a block diagram of a system that shows a related art ink-based digital printing system.

Exemplary embodiments are intended to cover all alternatives, modifications, and equivalents as may be included within the spirit and scope of the composition, apparatus and systems as described herein.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawing, like reference numerals are used throughout to designate similar or identical elements.

In one aspect, an ink-based digital printing system useful for ink printing comprising: an imaging member configured for carrying a fountain solution image on the imaging member; an image forming unit that forms an electrostatic charge image of a first polarity on the imaging member; a developer unit proximate the imaging member and adapted to form a fog of charged droplets that are attracted to the electrostatic charge image to form the fountain solution image on the imaging member; and, an inking system, the inking system being configured to apply ink as controlled spatially by the fountain solution image for developing the ink image.

In further aspect, the system further comprising an ink image transfer station positioned downstream of the inking system in a process direction that transfers the inked image from the imaging member to an image receiving media substrate; and ,wherein the inking system applies ink to the fountain solution image on the imaging member to produce the inked image.

In still further aspects the system, further comprising a transfer member, forming a transfer nip with the imaging member, for splitting a controlled fraction of the fountain solution image onto the transfer member; wherein the inking system applies ink to the fraction of the fountain solution image on the transfer member to produce the inked image; and, wherein the inked image is applied to a target image receiving media substrate.

In another aspect, the system wherein the developer unit further comprises an inlet for receiving a fountain solution and a discharge forming the fog of charged droplets, wherein the fog of charged droplets comprises multiple substantially uniformly sized electrically charged droplets of the fountain solution.

In yet another aspect, the system wherein the developer unit further comprising an outlet for clearing fountain solution from the developer unit.

In another further aspect, the system wherein the developer unit further comprising a charged surface disposed proximate the discharge and along the fog of charged droplets to guide the charged droplets to the imaging member.

In another aspect, the system wherein the fog of charged droplets is attracted to the electrostatic charge until the fog of charged droplets neutralizes the electrostatic charge image on the imaging member.

In still another aspect, the system further comprises a controller to create the formed fountain solution image with a desired thickness by controlling the image forming unit and the developer unit.

In yet another aspect, the system wherein the image forming unit is at least one of electrographic imaging system and ionographic imaging system.

In further aspect, the system wherein the liquid immersion fluid comprising a dampening fluid selected from the group consisting essentially of silicone fluids (including D4, D5, OS20, OS30), Isopar fluids.

In another aspect, the system wherein the imaging member comprising a surface selected from the group consisting essentially of silicone elastomers, fluorosilicone elastomers, and Viton.

In another aspect, the system wherein further comprising a transfer member the imaging member and the transfer member forming a fluid image loading nip, the transfer member being adapted to receive the formed fountain solution image at the image fluid loading nip.

In another aspect, the system wherein the fog of charged droplets consisting of frozen particles.

In another aspect, the system wherein the developer unit creates droplets from the fountain solution and suspends said droplets in a carrier gas to form the fog of charged droplets.

In further aspect a method of ink-based digital printing using fountain solution comprising forming a fountain solution image on an imaging member using an image forming unit and a developer unit, the developer unit being positioned proximate the imaging member and adapted to form a fog of charged droplets that are attracted to an electrostatic charge image to form the fountain solution image on the imaging member; applying ink with an inking system to produce an inked image according to the formed fountain solution image; and, transferring the inked image to a print substrate at an ink transfer nip.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The terms "dampening fluid", "dampening solution", and "fountain solution" generally refer to a material which adheres to a substrate and splits in an inking nip to reject ink from adhering to the substrate. In some situations the fountain solution can adhere to a substrate and bind ink which does not otherwise adhere to the substrate. Below we will speak of the former use, however it should be read as applying in either modality. The solution or fluid can be a water or aqueous-based fountain solution which is generally applied in an airborne state such as by vapor or by direct contact with a wetted imaging member through a series of rollers for uniformly wetting the member with the dampening fluid. The solution or fluid can be non-aqueous consisting of, for example, silicone fluids (such as D3, D4, D5, Os10, OS20, OS30 and the like), Isopar fluids, and polyfluorinated ether or fluorinated silicone fluid.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

The term "printing device", "printing system", or "digital printing system" as used herein refers to a digital copier or printer, scanner, image printing machine, digital production press, document processing system, image reproduction machine, bookmaking machine, facsimile machine, multifunction machine, or the like and can include several marking engines, feed mechanism, scanning assembly as well as other print media processing units, such as paper feeders, finishers, and the like. The digital printing system can handle sheets, webs, marking materials, and the like. A digital printing system can place marks on any surface, and the like and is any machine that reads marks on input sheets; or any combination of such machines.

The term "receiving medium" generally refers to a usually flexible, sometimes curled, physical sheet of paper, print substrate, plastic, or other suitable physical print media substrate for images, whether precut or web fed.

FIG. 1 shows a related art ink-based digital printing system for variable data lithography according to one embodiment of the present disclosure. System 10 comprises an imaging member 12 or arbitrarily reimageable surface since different images can be created on the surface layer, in this embodiment a blanket on a drum, but may equivalently be a plate, belt, or the like, surrounded by condensation-based dampening fluid subsystem 14, discussed in further detail below, optical patterning subsystem 16, inking subsystem 18, transfer subsystem 22 for transferring an inked image from the surface of imaging member 12 to a substrate 24, and finally surface cleaning subsystem 26. Other optional other elements include a rheology (complex viscoelastic modulus) control subsystem 20, a thickness measurement subsystem 28, control subsystem 30, etc. The imaging member 12 in the exemplary system 10 is used to apply an inked image to a target image receiving media substrate 24 at a transfer nip 160. The transfer nip 160 is produced by an impression roller, as part of an image transfer mechanism 22, exerting pressure in the direction of the imaging member 12. As noted above, optical patterning subsystem 16 is complex, expensive, and accounts for the majority of total power consumption of the whole system.

Figure 2:
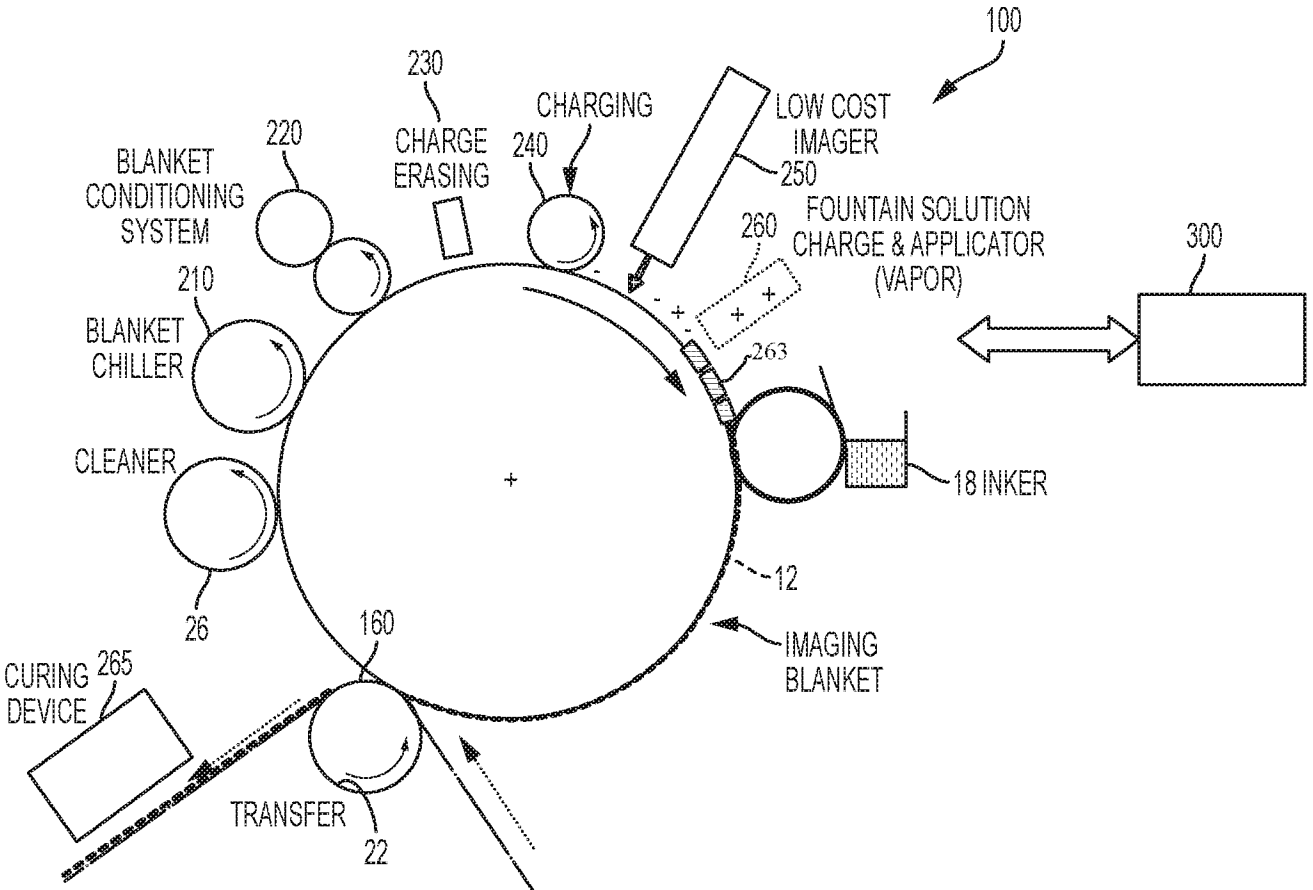
FIG. 2 is a side view of a system for variable lithography including fog development of a charge image created electrographically in accordance to an embodiment.
Figure 3:
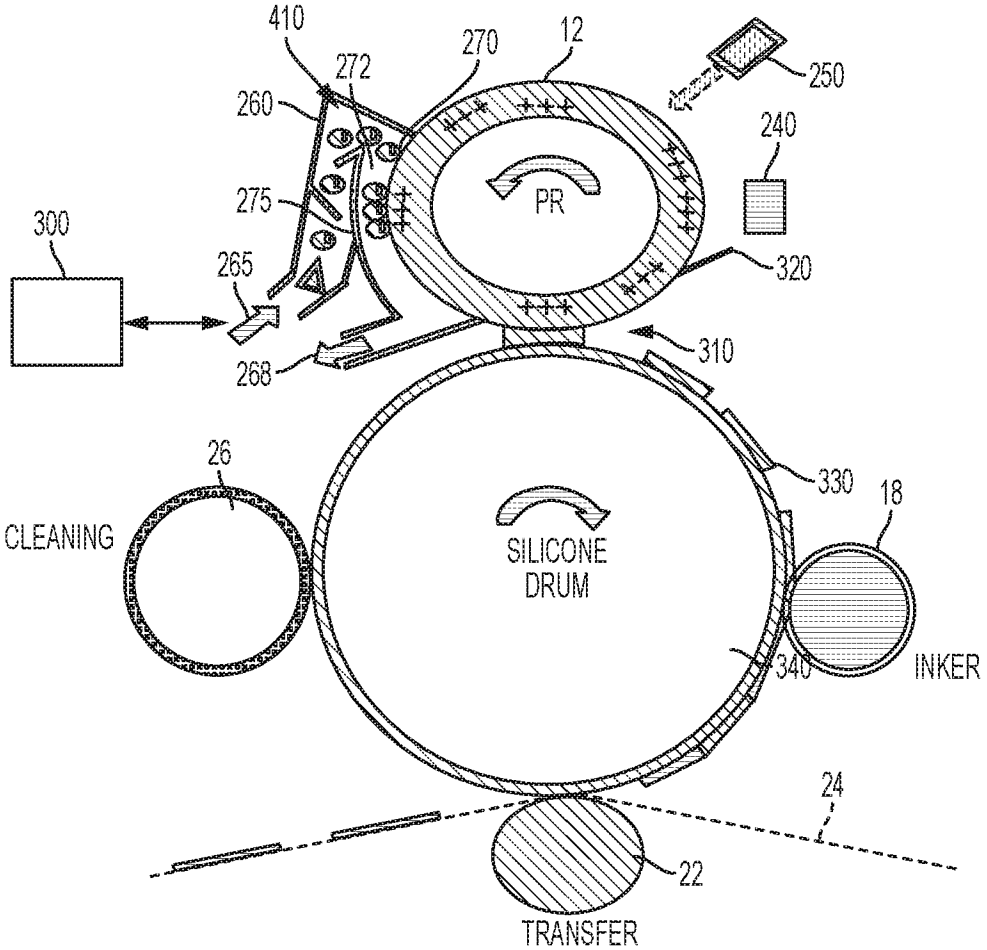
FIG. 3 is a side view of a system for variable lithography including fog development of a charge image created electrographically and including transferring of the fountain solution image to a surface such as a roller in accordance with another embodiment.
Figure 4:
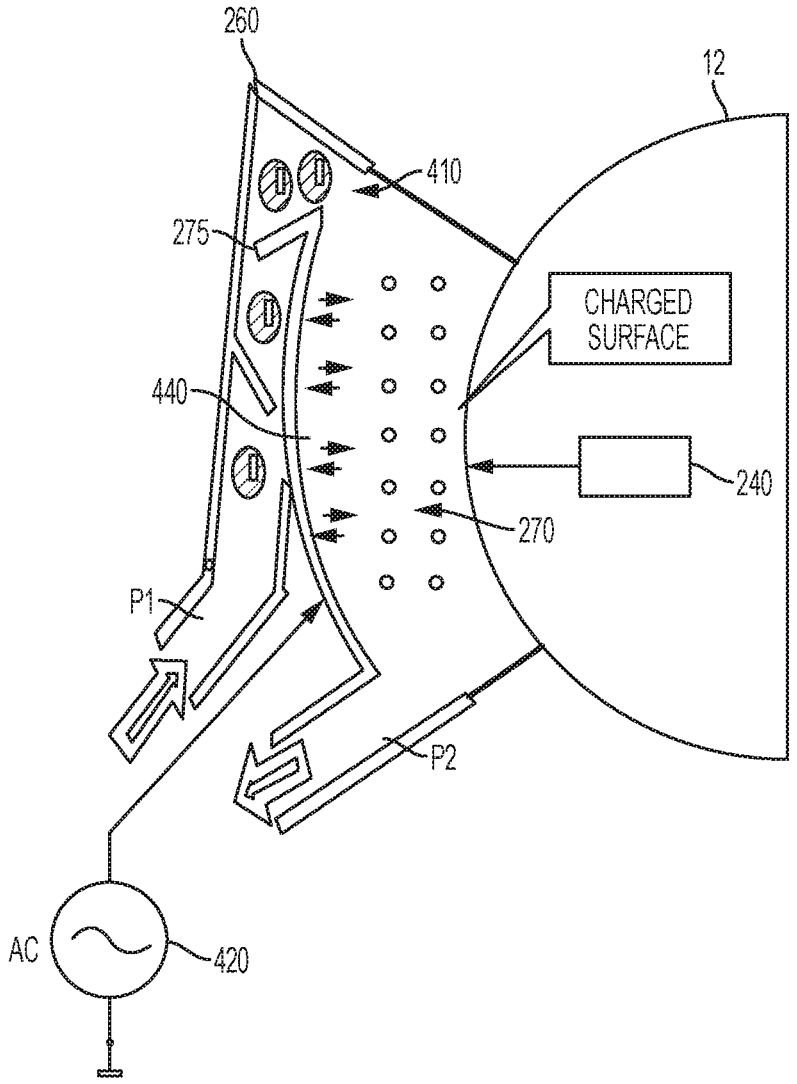
FIG. 4 shows fog development of a charge image in an ink-based digital printing system in accordance with an embodiment.

Having thus outlined a digital printing system for variable data lithography, and described various sequences of operation, reference is now made to FIGS. 2-4 showing further embodiments. These embodiments meet the need in the art for lowering power consumption in variable data lithography systems with increased system speed, lower system costs and enhanced plate lifetime. Specifically, the disclosed embodiments in FIGS. 2-5 create a fountain solution image using a fog developer and an electrographic/ionographic imaging system; and, then optionally the transferring of the fountain solution image to a fluoro-silicone plate. The use of electrographic printing in digital lithography lowers laser power requirements and is known to be several times faster than conventional laser evaporation techniques that require customized fluoro-silicone plates. Unless otherwise noted, elements similar to those previously described have been given the same reference numerals and serve the same functions.

FIG. 2 is a side view of a system for variable lithography 100 including fog development of a charge image created electrographically in accordance to an embodiment. The image can be from a source at the system 100 or externally from another device such as a memory. In particular, FIG. 2 shows an imaging member 12 for creating an image. The imaging member 12 may include a charge-retentive surface. In an embodiment, the imaging member surface may comprise photoreceptors, ceramic plates, silicone elastomers, fluorosilicone elastomers and Viton. Preferably, the imaging member surface may be a photoreceptor but an insulating surface could be used with an ionographic imaging system as well. Systems may include a dampening fluid/ink removal system 26 disposed adjacent to the imaging member surface. Systems may include a charging station 240 arranged and configured for charging to a first polarity the surface of imaging member 12. Systems may include a raster output scanner ("ROS") or imager forming unit (imager) 250 configured for selectively exposing a uniformly charged photoconductive surface according to image data for generating an electrostatic latent image (not shown) or charged image on a surface of the imaging member 12. In an alternative embodiment system 200 uses ionographic charging or discharging to create the charge image.

Systems may include a developer unit 260 or fluid metering system for presenting a uniform layer of fountain solution (not shown) onto a surface of the imaging member 12. The fountain solution is configured to adhere to portions of the imaging member surface according to the electrostatic latent image defined thereon by the ROS imager 250. The fountain solution comprises dampening fluid as charged droplets created by electrospray or other means of atomization. Preferably, the fountain solution is transported by a gas such as nitrogen to carry the charged droplets (charged fog) to the oppositely charged regions on the imaging member 12.

After the fountain solution image is formed, ink from an inker 18 is applied to a transfer member surface 231 to form an ink pattern or inked image. The ink pattern or inked image may be a negative of or may correspond to the dampening fluid pattern. The ink image may be transferred to media 24 at an ink image transfer nip 160 formed by the imaging member 12 and a substrate transport roll 22. The substrate transport roll 240 may urge a paper transport 24, for example, against the image member surface 12 to facilitate contact transfer of an inked image to the print medium carried by the paper transport 22.

Systems may include a rheological conditioning system like 20 in FIG. 1 for increasing a viscosity of ink of an ink image before transfer of the ink image at the ink image transfer nip 160. Systems may include a curing system 265 for curing an ink image on media after transfer of the ink image from the imaging member 12 to media carried by the paper transport 22, for example. The rheological conditioning system may be positioned before a transfer nip 160, with respect to a media process direction. The curing system 265 may be positioned after the nip 160, with respect to a media process direction. After transfer of the ink image from the imaging member 12 to the print media, residual ink may be removed by cleaning system 26.

After transfer of the dampening fluid pattern from the imaging member surface, the imaging member 12 may be further cleaned in preparation for a new cycle by removing dampening fluid and solid particles using the blanket conditioning system 220. Various methods for cleaning the imaging member surface may be used. Due to heat generated by the imager 250 and heat generated by frictional contact between the rollers and the imaging member 12 there may be a need to lower the temperature of the imaging member in between printing operations. In embodiments, the blanket may cool on its own by contact with the colder print substrate (24) and after the removal of heat. Optionally, a blanket chiller 210 such as an air jet producing device may be used to accelerate cooling. This is particularly suitable for printing at very high speeds.

The imager 250, developer unit 260, and other operations of the system for variable lithography may be controlled by controller 300. The controller 300 may be embodied within devices such as a desktop computer, a laptop computer, a handheld computer, an embedded processor, a handheld communication device, or another type of computing device, or the like. The controller 300 may include a memory, a processor, input/output devices, a display and a bus. The bus may permit communication and transfer of signals among the components of the controller 300 or computing device.

FIG. 3 is a side view of a system for variable lithography 200 including fog development of a charge image created electrographically and including transferring of the fountain solution image to a surface such as a roller in accordance with another embodiment. In the illustrated embodiment there is shown the creation of fountain solution image xerographically or ionographically on imaging member 12 and then transferring it (splitting) to the inking blanket such as drum 340 for further processing with a print substrate. In electrography or xerography an imager 250 comprising a conventional ROS scanner, LED bar, or other means to discharge the surface, may be implemented and configured to selectively discharge portions of the photoreceptor surface according to image data to generate an electrostatic latent image disposed on the surface of the imaging member. In ionography an imager 250 comprises image projection head for projecting ion beams, i.e., ions of a given polarity, onto a dielectric surface like surface on image member 12 after is charged by a charging station 240.

System 200 also includes a developer unit 260 for presenting a uniform layer of fountain solution (not shown) onto a surface of the imaging member 12. The fountain solution is configured to adhere to portions of the imaging member surface according to the electrostatic latent image developed thereon by imager 250. The developer unit 260 comprises a means of atomizing and charging a fountain solution 265 that enter an inlet port (P1). A pump, loaded with the fountain solution from a container, supplies the fountain solution to, for example, an electrospray nebulizer at a steady, controlled rate. The fountain solution of the sample can be silicone fluids (D4, D5, OS20, OS30) or Isopar fluids. The fluid may contain charge control agents to assist droplet charging. A gas such as nitrogen, added in a predetermined amount, is introduced to carry the atomized solution to the surface of imaging member 12. The developer unit 260 has an outlet port (P2) to move the unused fountain solution 268 back to the container. The developer unit 260 further includes chambers and a radially enlarged region 272 near plate 275 where a fog of charged droplets 270 from discharge chamber 410 can carry the atomized fountain solution to the charge region on the surface of imaging member 12.

A transfer member 340 may be configured to form a fountain solution image loading nip 310 with the imaging member 12. A fountain solution image produced by the developer unit 260 and imager unit 250 on the surface of the imaging member 12 is transferred to a transfer member 340 surface under pressure at the loading nip. In particular, a light pressure may be applied between the transfer member surface 340 and the imaging member surface 12. At the fountain solution loading nip, the fountain solution image splits as it leaves the nip, and transfers an amount of dampening fluid to the transfer member 340, forming the fountain solution fluid image 330. The amount of dampening fluid or fountain solution transferred may be adjusted by contact pressure adjustments of nip 310. For example, a dampening fluid layer of about 1 micrometer or less may be transferred to the transfer member surface 340. After transfer of the fountain solution pattern from the imaging member surface, the imaging member 12 may be cleaned in preparation for a new cycle by removing dampening fluid and solid particles using the removal system 320. Various methods for cleaning the imaging member surface may be used. After the fountain solution image 330 is transferred to the transfer member 340, ink from an inker 13 is applied to a transfer member surface 340 to form an ink pattern or image. The ink pattern or image may be a negative of or may correspond to the fountain solution pattern. The ink image may be transferred to print media 24 at an ink image transfer nip formed by the transfer member 340 and a substrate transport roll 22. The substrate transport roll 22 may urge a paper transport 24, for example, against the transfer member surface 340 to facilitate contact transfer of an ink image from the transfer member 340 to media carried by the paper transport 22. Like the imaging member 12, the transfer member 340 may be electrically biased to enhance loading of the dampening fluid image at the loading nip 310.

FIG. 4 shows fog development of a charge image in an ink-based digital printing system in accordance with an embodiment. As used herein, the term "fog development" is the creation of an image by using charged liquid or frozen particles such as atomized droplets.

Having thus outlined several embodiments of printing apparatus and processes, and described various sequences of operation, reference is now made to FIG. 4 showing a further embodiment with certain elements omitted for simplicity. Unless otherwise noted, elements similar to those previously described have been given the same reference numerals and serve the same functions. The illustrated segment uses fog development of an electrographic image as an alternative and improved means of creating the fountain solution image on a surface.

As shown in FIG. 4 a fog of droplets 270, around one (1) micron in diameter, is charged and presented to the charge image on the surface imaging member 12. The surface shown could be a photoreceptor, but when the application is an ionographic imaging system an insulating surface could be used to create the charge image. The developer unit 260 can create the charged droplets for example by electrospray or other means of atomization and charging of a fountain solution received at a first port (P1). A gas such as nitrogen carries the fog of charged droplets 270 to the rotating counter charge image on the imaging member 12 that could be a drum or belt where the electric fields (mutual attraction between droplets and surface) guide the droplets to the charged regions of the charge image. It is desirable, but not necessary, that the droplets have a narrow distribution of size and charge to mass ratio (C/M). The droplets desirably have a diameter of around one (1) 1 micron. A pixel of area 20×20 microns (corresponding to 1200 dpi imaging) and a target fountain solution thickness of around 200 nano-meters (nm) would need around 150 droplets to provide the desired coverage. The surface charge density (created by charging station 240) of the latent image attracts a volume of fountain solution until the surface charge is optionally neutralized or partially neutralized by the fog charged droplets. Adhesion forces with the imaging member and each other will cause the droplets to remain on the surface of imaging member 12.

By controlling, such as with controller 300, the charge to mass ratio and the droplet volume parameters and the electrographic surface charge density a desired thickness of fountain solution can controllably coat the latent image regions on the imaging member 12. Voltages on walls of the developer housing can be set so that charged droplets are repelled from uncharged regions of the image. Where no latent image charge resides droplets do not contact the surface of imaging member 12 and stick thereon or can be electrostatically repelled. Unused free droplets can be recycled through a second port (P2). In addition an alternating current (AC) field like voltage 420 applied at plate 275 creates a charged surface 440 to cause a charged wall potential that can reduce the number of droplets near the discharged regions; and, since the discharge surface 440 is disposed proximate the discharge port 410 and the fog of charged droplets the electrostatic force can help in guiding the charged droplets to the surface of imaging member 12.

It should be noted that the fog once generated can be frozen. For example fountain solution like D4 freezes at 17.5 C. So if the carrier gas like nitrogen and the housing of developer unit 260 are maintained below 17 C the fog 270 will consist of frozen particles. Such frozen particles can be useful in controlling the capillary spreading forces of a liquid on a surface like outer surface of imaging member 12. If such particles remain frozen all the way to the nip 310 between the electrographic surface and the transfer member 340 the nip pressure can act to melt the fountain solution and wet the transfer member 340. Alternatively a heat source can be used to melt the fountain particles just before transfer to the transfer member. In yet another alternative a compliant silicone transfer member 340 can preferentially adhere to solid fountain particles and effectively transfer them to the silicone plate where they can subsequently melt before inking.

Figure 5:
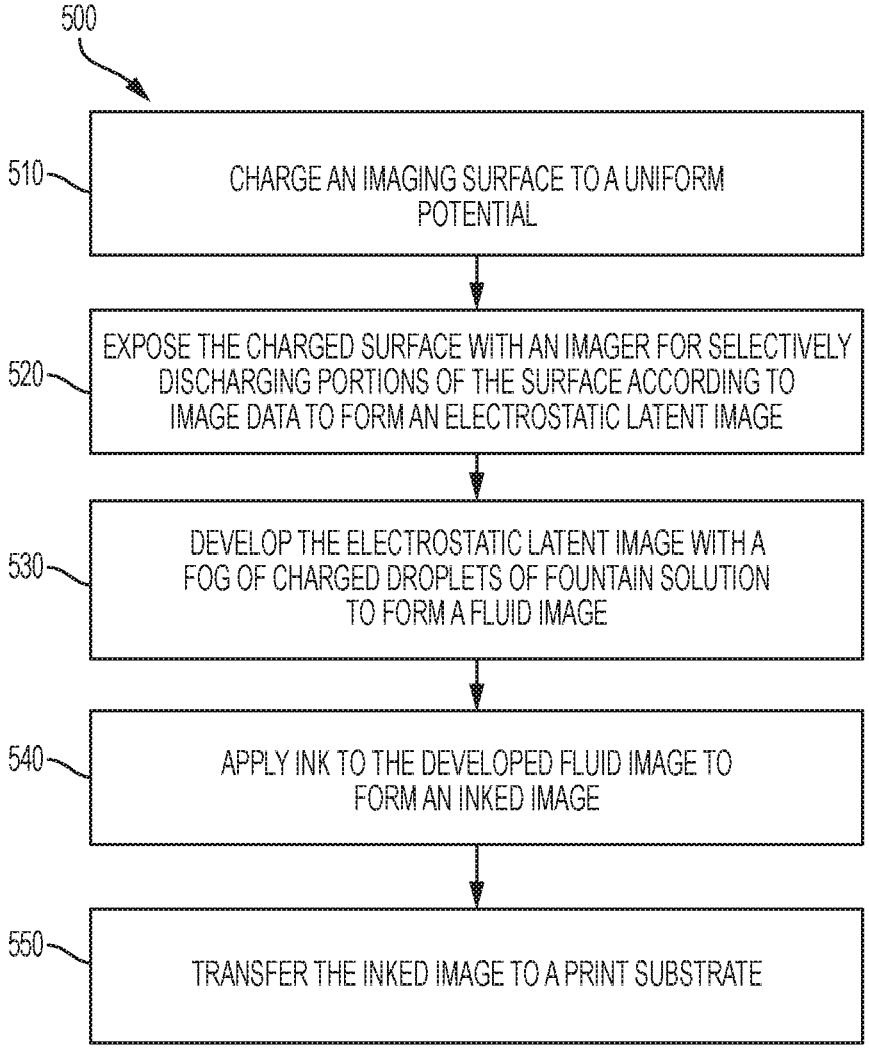
FIG. 5 is a flowchart of a method for fog development of a charge image on an arbitrarily reimageable surface in accordance to an embodiment.

FIG. 5 is a flowchart of a method 500 for fog development of a charge image on an arbitrarily reimageable surface in accordance to an embodiment. In particular, FIG. 5 shows an ink-based digital printing process 500. Methods may include charging the surface of an imaging member 12 such as a photoreceptor to a uniform potential at 510. The charged surface of the of the imaging member 12 may be exposed at 520 to an electrophotography imager such as a ROS imager or to an ionographic imager to selectively discharge portions of the surface according to image data of an image to be printed to form an electrostatic latent image or electrostatic charge image.

After creation of the electrostatic latent image, control is then passed to action 530 for development of the image using a developer unit 260 that uses a charged fog of fountain solution that is electrically biased or charged to cause the droplets/particles to adhere to portions of the imaging member 12 having complementary charge. As a result of action 530, a fountain solution image is created without the need of high power lasers, currently used for patterning dampening fluid on an imaging plate, and which account for most of the power usage and reduction in print speed. Control is then passed to action 540 for further processing.

Methods may include inking the imaging member surface having the fountain solution image at action 540. The ink may adhere to portions of the transfer member according to the fountain solution image. For example, the ink may form a positive or negative image or pattern with respect to the fountain solution image. Methods may include transferring the ink image to a recording medium at an ink image transfer nip at action 550. The transfer nip may be formed by a transfer roll 22 and the imaging member 12 or drum 340 like shown in FIGS. 2 and 3, and may be configured to apply pressure to an interposing recording medium, whether cut sheet or continuous web.

Figure 6:
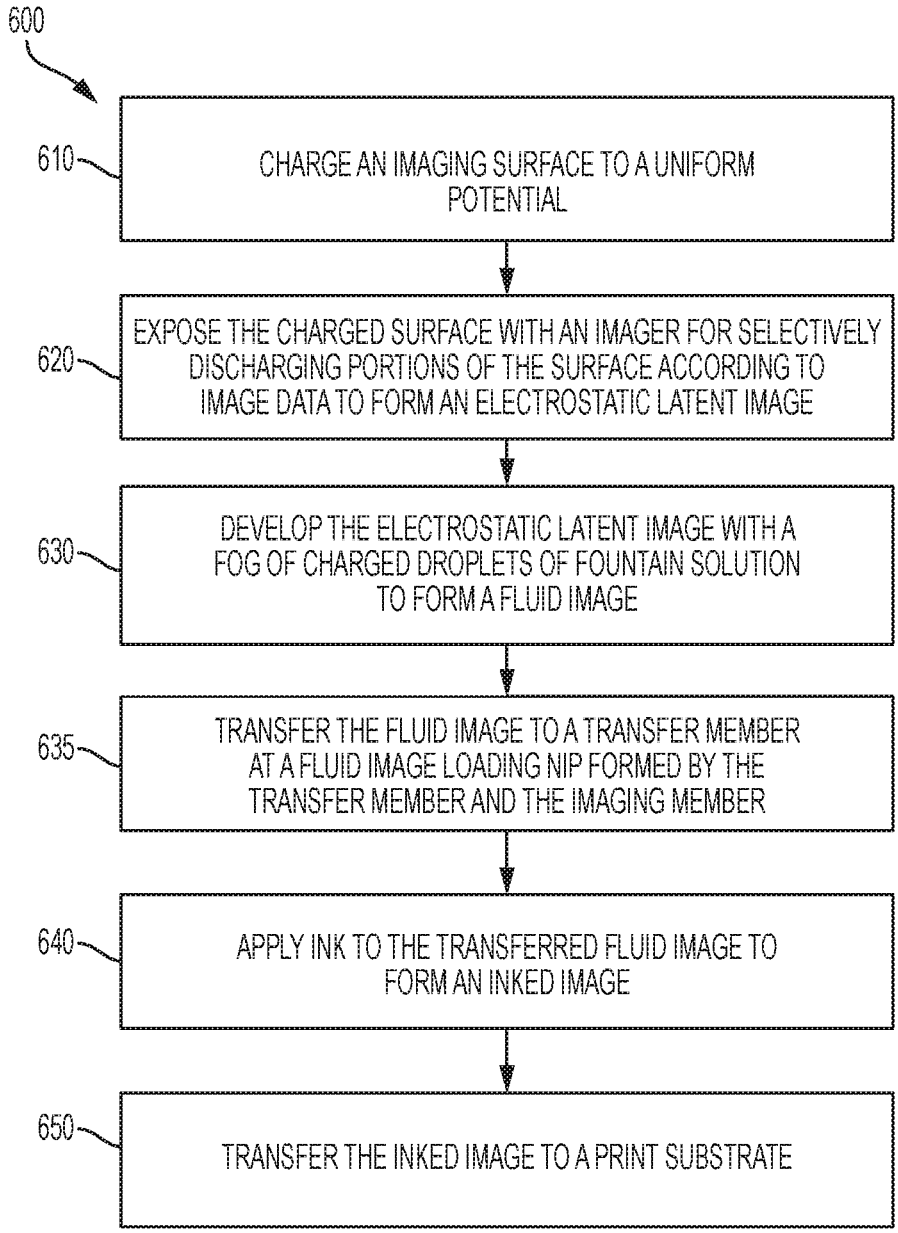
FIG. 6 is a flowchart of a method for fog development of a charge image on an arbitrarily reimageable surface in an ink-based digital printing system with a transfer member in accordance to an embodiment.

FIG. 6 is a flowchart of a method 600 for fog development of a charge image on an arbitrarily reimageable surface in an ink-based digital printing system with a transfer member in accordance to an embodiment.

In particular, FIG. 6 shows an ink-based digital printing process 600. Methods may include charging the surface of an imaging member 12 such as a photoreceptor to a uniform potential at 610. The charged surface of the of the imaging member 12 may be exposed at 620 to an electrophotography imager such as a ROS imager or to an ionographic imager to selectively discharge portions of the surface according to image data of an image to be printed to form an electrostatic latent image or electrostatic charge image.

After creation of the electrostatic latent image, control is then passed to action 630 for development of the image using a developer like developer unit 260 that uses a fog of fountain solution that is electrically biased or charged to cause the droplets/particles to adhere to portions of the imaging member 12 having complementary charge. Developing the electrostatic image with a fog of fountain solution overcomes the sensitivity to humidity associated with liquid ink printing. As a result of action 630, a fountain solution image is created without the need of high power lasers, currently used for patterning dampening fluid on an imaging plate, and which account for most of the power usage and reduction in print speed. Control is then passed to action 635 for further processing.

Methods may include transferring fountain solution of the solution image to a transfer member 340 at loading nip 310 formed by the imaging member 12 and a transfer member 340 at S509. A fountain solution image thereby is formed that corresponds to the fountain solution image of the imaging member as developed by developer unit 260. Methods may include biasing the imaging member 12 and the transfer member 340 to retain the fountain solution image on the surface of the imaging member as the solution image is transferred from the imaging member to transfer member 340.

Methods may include inking the imaging member surface having the fountain solution image at action 640. The ink may adhere to portions of the transfer member according to the fountain solution image. For example, the ink may form a positive or negative image or pattern with respect to the fountain solution image. Methods may include transferring the ink image to a recording medium at an ink image transfer nip at action 650. The transfer nip may be formed by a transfer roll 22 and the imaging member 12 or drum 340 like shown in FIGS. 2 and 3, and may be configured to apply pressure to an interposing recording medium, whether cut sheet or continuous web.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An ink-based digital printing system useful for ink printing, comprising:

an imaging member configured for carrying a fountain solution image on the imaging member;

an image forming unit that forms an electrostatic charge image of a first polarity on a surface of the imaging member;

a developer unit proximate the imaging member and adapted to form a fog of charged droplets that are attracted to the electrostatic charge image to form the fountain solution image on the imaging member; and, an inking system, the inking system being configured to apply ink to produce an inked image according to the formed fountain solution image; and an ink transfer nip for transferring the inked image to a receiving medium.

2. The system of claim 1, further comprising:

wherein the inking system applies ink to the imaging member according to the fountain solution image on the imaging member to produce the inked image;

an ink image transfer station positioned downstream of the inking system in a process direction that transfers the inked image to an image receiving medium substrate.

3. The system of claim 1, further comprising:

a transfer member, forming a transfer nip with the imaging member, for splitting a controlled fraction of the fountain solution image onto the transfer member;

wherein the inking system applies ink to the transfer member according to the fraction of the fountain solution image on the transfer member to produce the inked image;

wherein the inked image is applied to the image receiving medium substrate.

4. The system of claim 1, the developer unit further comprising:

an inlet for receiving a fountain solution and a discharge forming the fog of charged droplets, wherein the fog of charged droplets comprises multiple substantially uniformly sized electrically charged droplets of the fountain solution.

5. The system of claim 4, the developer unit further comprising:

an outlet for clearing the fountain solution away from the developer unit.

6. The system of claim 4, the developer unit further comprising:

a charged surface disposed proximate the discharge and along the fog of charged droplets to guide the charged droplets to the imaging member.

7. The system of claim 4, further comprising:

a controller to create the fountain solution image on the imaging member with a desired thickness by controlling the image forming unit and the developer unit;

wherein the fog of charged droplets is attracted to the electrostatic charge until the fog of charged droplets neutralizes the electrostatic charge image on the imaging member.

8. The system of claim 4, wherein the image forming unit is at least one of electrographic imaging system and ionographic imaging system.

9. The system of claim 8, the fountain solution comprising:

a dampening fluid selected from the group consisting essentially of silicone fluids (including D4, D5, OS20, OS30), Isopar fluids.

10. The system of claim 7, the imaging member comprising:

a surface selected from the group consisting essentially of silicone elastomers, fluorosilicone elastomers, and Viton.

11. The system of claim 10, wherein the developer unit creates droplets from the fountain solution and suspends said droplets in a carrier gas to form the fog of charged droplets.

12. The system of claim 7, wherein the fog of charged droplets consist of frozen particles.

13. A method of ink-based digital printing using fountain solution fluid, comprising:

forming a fountain solution image on an imaging member using an image forming unit and a developer unit, the developer unit being positioned proximate the imaging member and adapted to form a fog of charged droplets that are attracted to an electrostatic charge image to form the fountain solution image on the imaging member;

applying ink with an inking system to produce an inked image according to the formed fountain solution image; and, transferring the inked image to a print substrate at an ink transfer nip.

14. The method of claim 13, further comprising:

wherein the inking system applies ink to the imaging member according to the fountain solution image on the imaging member to produce the inked image;

transferring the inked image from the imaging member to a print substrate at a transfer station positioned downstream of the inking system in a process direction.

15. The method of claim 13, further comprising:

splitting a controlled fraction of the fountain solution image onto the transfer member with a transfer member forming a transfer nip with the imaging member;

wherein the inking system applies ink to the transfer member according to the fraction of the fountain solution image on the transfer member to produce the inked image;

wherein the inked image is applied to a target image receiving print substrate.

16. The method of claim 15, the developer unit further comprising an inlet for receiving a fountain solution and a discharge forming the fog of charged droplets, wherein the fog of charged droplets comprises multiple substantially uniformly sized electrically charged droplets of the fountain solution.

17. The method of claim 16, the developer unit further comprising an outlet for clearing the fountain solution from the developer unit.

18. The method of claim 16, the developer unit further comprising a charged surface disposed proximate the discharge and along the fog of charged droplets to guide the charged droplets to the imaging member.

19. The method of claim 18, wherein the fog of charged droplets is attracted to the electrostatic charge until the fog of charged droplets neutralizes the electrostatic charge image on the imaging member.

20. The method of claim 16, further comprising:

controlling the image forming unit and the developer unit to form the fountain solution image with a desired thickness.

21. The method of claim 16, wherein the image forming unit is at least one of electrographic imaging method and ionographic imaging method.

22. The method of claim 21, the fountain solution comprising:

a dampening fluid selected from the group consisting essentially of silicone fluids (including D4, D5, OS20, OS30), Isopar fluids.

23. The method of claim 22, the imaging member comprising:

a surface selected from the group consisting essentially of silicone elastomers, fluorosilicone elastomers, and Viton.

24. The method of claim 21, wherein the fog of charged droplets consist of frozen particles.

25. The method of claim 23, wherein the developer unit creates droplets from the fountain solution and suspends said droplets in a carrier gas to form the fog of charged droplets.

* * * * *